US005416973A

United States Patent [19]

Brown et al.

[11] Patent Number: 5,416,973

[45] Date of Patent: May 23, 1995

[54] RAZORS

[75] Inventors: Frank E. Brown, Maidenhead; Alan Crook, Basingstoke; Oliver D. Oglesby, Tadley; Brian Oldroyd, Reading, all of England

[73] Assignee: The Gillette Company, Boston, Mass.

[21] Appl. No.: 130,027

[22] Filed: Sep. 30, 1993

[51] Int. Cl.[6] ..... B26B 19/42

[52] U.S. Cl. ..... 30/34.2; 30/84

[58] Field of Search ..... 30/34.2, 34.05, 32, 30/47, 48, 49, 50, 77, 84

[56] References Cited

U.S. PATENT DOCUMENTS

| | | | |
|---|---|---|---|
| 2,666,982 | 1/1954 | Schroder | 30/77 |
| 3,116,550 | 1/1964 | De-Paoli | 30/34.2 |
| 4,914,817 | 4/1990 | Galligan et al. | 30/77 |
| 5,056,222 | 10/1991 | Miller et al. | 30/77 |
| 5,067,238 | 11/1991 | Miller et al. | 30/34.2 |
| 5,191,712 | 3/1993 | Crook et al. | 30/34.2 |
| 5,249,361 | 10/1993 | Apprille, Jr. et al. | 30/77 |

FOREIGN PATENT DOCUMENTS

| | | |
|---|---|---|
| 2092052 | 8/1982 | United Kingdom . |
| WO90/05047 | 5/1990 | WIPO . |

OTHER PUBLICATIONS

British Patent Application No. 88 25 268.9, filed Oct. 28, 1988.

*Primary Examiner*—Hwei-Siu Payer

*Attorney, Agent, or Firm*—Fish & Richardson

[57] ABSTRACT

A safety razor blade unit has cap structure with upstanding fin elements directed perpendicular to the blade edges to define a cap surface featuring low frictional resistance characteristics during shaving. The fin elements are spaced at a pitch distance of 0.3 to 0.7 millimeter, are 0.3 to 1.0 millimeter in height and are substantially triangular in cross-section with an aspect ratio of 2:1 to 4:1.

20 Claims, 1 Drawing Sheet

RAZORS

BACKGROUND OF THE INVENTION

This invention relates to safety razors, and in particular concerns a blade unit for a safety razor. The blade unit may be attached permanently to a razor handle and either rigid with the handle or connected to it for pivotal movement. The entire razor may be disposable, i.e. intended to be discarded when the blade edges have become dulled or the blades may be replaceable. Alternatively the blade unit may consist of a cartridge releasably mounted on the handle for replacement of the cartridge when the blade edges have become blunted. As well known in the art, shaving cartridges may be mounted in fixed position or pivotally on a razor handle.

A razor blade unit generally comprises one or more blades supported by a blade carrier, guard structure for contact with the skin being shaved in front of the blade(s) and cap structure for contact with the skin being shaved behind the blade(s). The guard and cap structure can each be formed integrally with the blade carrier or may consist of a separate part assembled with the blade carrier. The guard structure, which serves to stretch the skin in front of the following blade during shaving, can take various forms. Similarly, various surface configurations for the cap have been proposed, although it does not have the same requirements as the guard as far as stretching the skin is concerned. In U.S. Pat. No. 5,191,712 for example there are described different surface defining arrangements for the guard and/or cap which promote pleasant tactile sensations in use of a razor with the intention of masking the unfavorable feelings produced by the movement blade edges over the skin and their contact with the facial hairs. In U.S. Pat. No. 4,535,537 there is disclosed a cap surface defined by a series of flat-topped posts spaced apart in the longitudinal direction of the blade edges to leave exit channels for shaving debris. In recent years it has become common practice to equip shaving cartridges with lubricating strips which form the cap and which in use discharge small amounts of lubricant to reduce friction during shaving. The strips of lubricating material produce very favorable results, but have a disadvantage in that they tend to suffer from wear as the lubricant is used up and can become rather unsightly. These problems are not very serious in the case of disposable razors, or shaving cartridges, since the lubricating strip is in effect renewed whenever a fresh blade is used. Nonetheless, there is a need for a cap which will produce similar results to a lubricating strip, but which has a substantially longer service lifetime.

SUMMARY OF THE INVENTION

In accordance with the present invention, there is provided a safety razor blade unit comprising cap structure with parallel upstanding fin elements all having upper edges directed substantially perpendicularly to the blade edge(s) of the blade unit, the fin edges together defining a cap surface spanning an area many times greater than the sum of the contact areas of the individual fin elements whereby the cap structure engages a surface being shaved only at a series of separate parallel contact areas spaced apart at distances several times greater than the width of the individual contact areas.

In contrast to the finned guard and/or cap surfaces proposed by U.S. Pat. No. 5,191,712, wherein the fins are adapted to rub against the skin to stimulate a pleasant sensation, the fin elements of the cap structure according to the present invention are arranged to slide over the skin making minimal contact. It has been surprisingly found from shaving tests that a cap in accordance with the invention can perform equally to a cap consisting of a lubricating material.

The cap structure can be made integrally with a blade carrier. Alternatively it may consist of a separately manufactured part secured onto the blade carrier.

In preferred constructions, the cap structure of the invention consists of a thermoplastic material, in particular a thermoplastic elastomer with a hardness of less than 90 Shore A. Suitable materials include polyethylene, polyvinylchloride, ethylene vinyl acetate and synthetic rubber. The cap structure is formed as a molding and the fin elements are spaced uniformly apart at a pitch in the range of 0.3 to 0.7 millimeter, and ideally substantially equal to 0.5 millimeter. The fin edges are very narrow to provide essentially linear contact with the skin, but obviously are not so sharp as to present any risk of cutting the skin. As viewed in cross-section the fin elements are substantially triangular with an apex angle of around 15°, the height of the fin elements being in the range of 0.3 to 1.0 millimeter, their aspect ratio of height to base width being in the range of 2:1 to 4:1, and their upper edges being in the range of 0.01 to 0.05 millimeter radii. In the embodiment specifically described hereinbelow, the cap member is molded of Evoprene 966 TM, a thermoplastic elastomer of the styrene-ethylene butylene-styrene (SEBS) type with a hardness of 27 Shore A, the fin element height is substantially equal to 0.75 millimeter, the aspect ratio is substantially equal to 3.75, and the upper fin edges have a radius of about 0.015 millimeter. The leading and trailing ends of the fin elements are rounded off, e.g. at a radius of approximately 0.3 millimeter.

BRIEF DESCRIPTION OF THE DRAWING

A particular embodiment of the invention will now be described in greater detail with reference to the accompanying drawing, in which.

DESCRIPTION OF PARTICULAR EMBODIMENT

Figure 1:
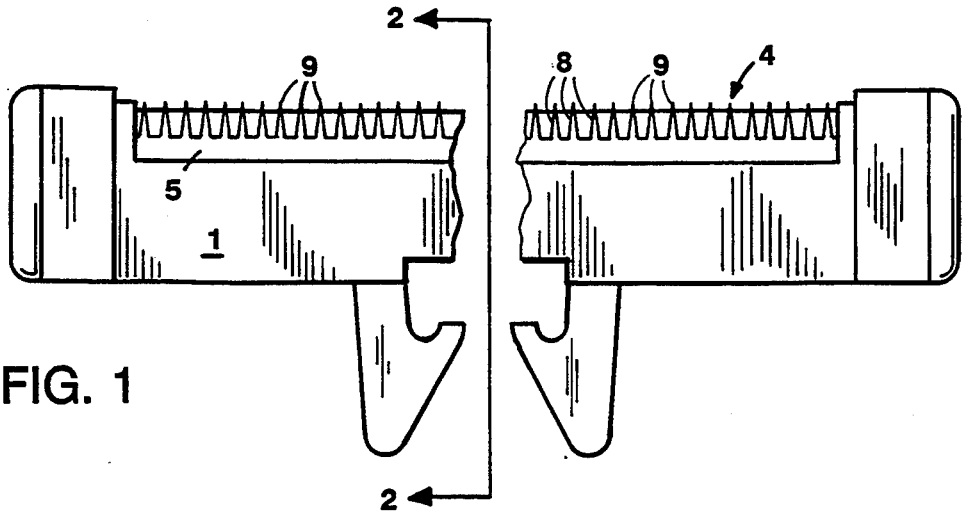
FIG. 1 is a partly cut away rear elevation of a shaving cartridge in accordance with the invention.
Figure 2:
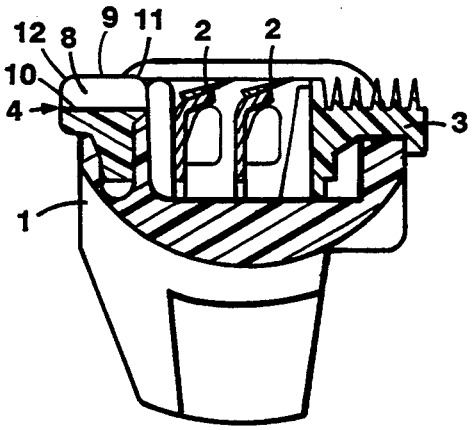
FIG. 2 is a transverse cross section taken along the line 2—2 of FIG. 1.

The shaving cartridge illustrated in FIGS. 1 and 2 is of the general type shown in U.S. Pat. No. 4,551,916 and includes blade carrier frame 1 on which are mounted a pair of blade elements 2, guard member 3 and separately molded cap member 4. The guard is shown to have upstanding fins directed parallel to the blade edges and may be as described in U.S. Pat. No. 5,191,712.

Figure 4:
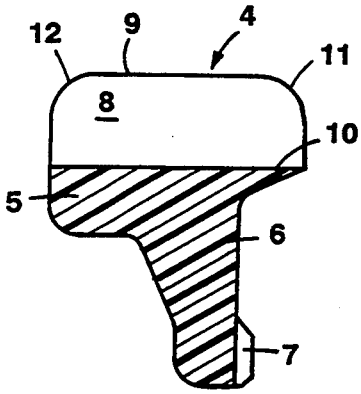
FIG. 4 is an enlarged scale cross section of the cap member taken along the line 4—4 of FIG. 3.
Figure 3:
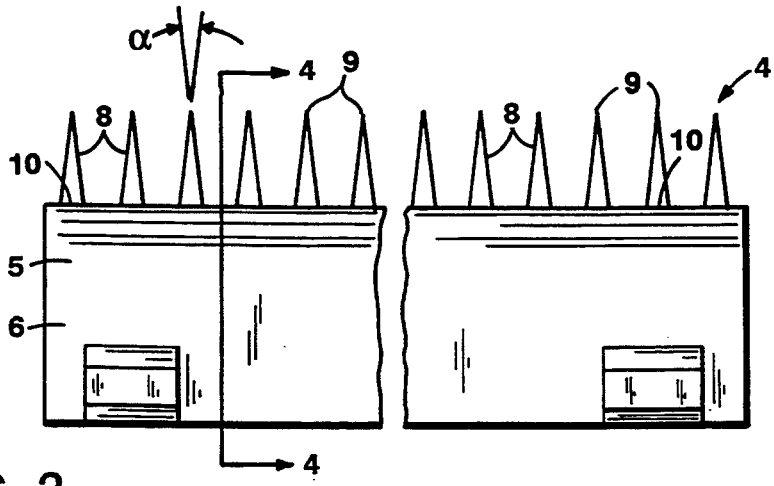
FIG. 3 is an enlarged scale front elevation of the cap member.

The cap member 4, shown in detail in FIGS. 3 and 4, is an integral molding of elastomeric material (Evoprene 966 TM of 28 Shore A hardness) and includes base portion 5 from which projects downwardly flange 6 adapted to fit into a slot provided therefore in the blade carrier 1. Projections 7 on flange 6 engage behind a shoulder defined in the slot to retain the cap member 4 securely attached to the frame 1. Upstanding from the base portion 5 are a series of spaced parallel fin elements 8 of substantially triangular cross-section extending in a direction transversely perpendicular to the longitudinal plane of the base portion 5 and hence the blade cutting edges in the assembled cartridge. The fin elements are uniformly spaced at a pitch of 0.5 millimeter, and are sixty-four in number, the total length of the cap member being 32.5 millimeters. The height of the fin elements is 0.75 millimeters from the fin tips 9 to the fin bases 10, their aspect ratio is around 3.75, the apex angle $\alpha$ of their cross section being 15.2°, and their tips 9 have a radius of 0.015 millimeter. The fin elements 8 have a length of 2.16 millimeters along the fin bases 10 and perpendicular to the blade edges and at the leading end 11 and trailing end 72 the upper-edges are rounded off at a radius of 0.3 millimeter.

It will be appreciated the fin tips 9 define very narrow, continuous rectilinear contact areas for engagement with a skin surface being shaved, but the edges are not so sharp as to be capable of cutting the skin. Together the fin tips 9 define a cap surface spanning an area many times greater than the sum of the contact areas defined by the individual fin tips 9 (i.e., the surface defined by the fin tips and the spacing between the fin tips is substantially greater than the surface area of the fin tips themselves), but due to the comparatively close spacing of the fin elements 8, the feel to the skin is not significantly different to that of a smooth continuous surface. Due to the low area of actual contact, and the fin tips 9 extending in the normal direction of movement over the skin surface, i.e. perpendicular to the blade edges, the frictional resistance due to the contact between the cap structure and skin is very low.

Modifications are possible without departing from the spirit and scope of the invention as elucidated in the claims which follow. For example, the fins edges need not be continuous and could be provided with one or more interruptions along their length.

What is claimed is:

1. A safety razor blade unit comprising at least one blade, a guard structure that contacts and stretches the skin being shaved in front of the blade during shaving, and a cap structure that contacts the skin being shaved behind the blade, said cap structure having a series of spaced apart upstanding fin elements, said spaced apart fin elements defining substantially unobstructed regions between adjacent fin elements and extending the length of each said fin element, each said spaced apart fin element having a leading end, a trailing end and a fin base extending from the leading end to the trailing end, said fin base extending substantially perpendicular to a cutting edge of said blade, each said spaced apart fin element further having a narrow upper edge above said fin base and extending substantially perpendicular to the cutting edge of said blade, said spaced apart fin upper edges in combination defining a cap surface spanning an area greater than the sum of contact areas of the individual fin upper edges, wherein said cap surface will engage the skin being shaved at a series of separate contact areas spaced apart at distances several times greater than a width of each of the separate contact areas.

2. A safety razor blade unit according to claim 1, wherein said fin elements are spaced apart at a pitch distance in the range of 0.3 to 0.7 millimeter.

3. A safety razor blade unit according to claim 2, wherein said fin elements are spaced apart at a pitch distance substantially equal to 0.5 millimeter.

4. A safety razor blade unit according to claim 1, wherein said fin elements have a height in the range of 0.3 to 1.0 millimeter.

5. A safety razor blade unit according to claim 4, wherein the height of said fin elements is substantially equal to 0.75 millimeter.

6. A safety razor blade unit according to claim 1, wherein said fin elements have an aspect ratio in the range of 2:1 to 4:1.

7. A safety razor blade unit according to claim 1, wherein each said fin element is substantially triangular in cross section.

8. A safety razor blade unit according to claim 1, wherein each said fin upper edge extends continuously from the leading end to the trailing end of said fin element.

9. A safety razor blade unit according to claim 8 wherein the leading ends of said fin elements are rounded off.

10. A safety razor blade unit according to claim 1, wherein said cap structure includes a molded member of thermoplastic material, said molded member including a base portion and said fin bases, and said fin elements projecting upwardly from said base portion.

11. A safety razor blade unit according to claim 10 wherein said thermoplastic material has a hardness of less than 90 Shore A.

12. A safety razor blade unit according to claim 11 wherein said thermoplastic material is selected from the class consisting of polyethylene, polyvinylchloride, ethylene vinyl acetate and synthetic rubber.

13. A safety razor blade unit according to claim 1 wherein said fin element upper edges have radii in the range of 0.01 to 0.05 millimeter.

14. A safety razor blade unit according to claim 13, wherein said fin elements are spaced apart at a pitch distance in the range of 0.3 to 0.7 millimeter.

15. A safety razor blade unit according to claim 14, wherein said fin elements have a height in the range of 0.3 to 1.0 millimeter.

16. A safety razor blade unit according to claim 15, wherein said fin elements have an aspect ratio in the range of 2:1 to 4:1.

17. A safety razor blade unit according to claim 16, wherein each said fin upper edge extends continuously from the leading end to the trailing end of said fin element.

18. A safety razor blade unit according to claim 17, wherein said cap structure includes a molded member of thermoplastic material, said molded member including a base portion and said fin bases, and said fin elements projecting upwardly from said base portion.

19. A safety razor blade unit according to claim 18 wherein said thermoplastic material is selected from the class consisting of polyethylene, polyvinylchloride, ethylene vinyl acetate and synthetic rubber.

20. A safety razor blade unit according to claim 19 wherein said thermoplastic material has a hardness of less than 90 Shore A.

* * * * *